US005481828A

United States Patent [19]

Kentrotas

[11] Patent Number: 5,481,828

[45] Date of Patent: Jan. 9, 1996

[54] SECURITY POST FOR AUTOMOBILES

[76] Inventor: Andreas Kentrotas, 134-06 58th Rd., Flushing, N.Y. 11355

[21] Appl. No.: 316,728

[22] Filed: Oct. 3, 1994

[51] Int. Cl.[6] ..... E05B 65/00

[52] U.S. Cl. ..... 49/35; 49/49

[58] Field of Search ..... 404/6, 9, 11; 49/49, 49/35, 131

[56] References Cited

U.S. PATENT DOCUMENTS

| | | | |
|---|---|---|---|
| 3,660,935 | of/1972 | Boots . | |
| 3,688,439 | 9/1972 | Doxsee . | |
| 3,698,135 | 10/1972 | Boots et al. | 49/49 X |
| 4,713,910 | 12/1987 | Quante . | |
| 4,715,742 | 12/1987 | Dickinson | 49/49 X |
| 5,054,237 | 10/1991 | Kapala et al. | 49/49 X |
| 5,070,646 | 12/1991 | Colombo | 49/49 |
| 5,192,159 | 3/1993 | Higginson | 49/49 X |
| 5,365,694 | 11/1994 | Macaluso | 49/49 |

FOREIGN PATENT DOCUMENTS

| | | | |
|---|---|---|---|
| 2275289 | 8/1994 | United Kingdom | 49/49 |

*Primary Examiner*—Brian K. Green
*Assistant Examiner*—Jerry Redman
*Attorney, Agent, or Firm*—Collard & Roe

[57] ABSTRACT

A security post for automobiles vertically disposed in the ground to allow or prevent access to a particular area. The post is manually withdrawn form the ground and secured in place with a securing bolt and lock. Guides on the post provide and easily slidable member within a sleeve that is disposed in the ground. A cover is provided for preventing the accumulation of dirt or other foreign particles on the top of the post and sleeve.

16 Claims, 4 Drawing Sheets

SECURITY POST FOR AUTOMOBILES

BACKGROUND OF THE INVENTION

1. Field of the Invention

The present invention relates to security devices for automobiles. More particularly, it relates to a retractable security post for preventing access to a particular parking position with or without an automobile parked therein.

2. The Prior Art

U.S. Pat. No. 4,713,910 to Quante, discloses a barrier post for parking lots and passageways. The invention consists of a collapsible post for securing parking places. In one particular embodiment of the invention, a retractable post is shown whereby the entire post is embedded in the ground vertically in an open position, and above the ground when in its closed position. In addition, the use of remote control operation of the post is disclosed. Thus, the user need not get out of the vehicle in order to open and close the position of the barrier post.

U.S. Pat. No. 3,688,439 to Doxsee, discloses a barrier for parking places. The invention shows a base plate permanently affixed to the ground, and a barrier post pivotally secured to the base plate. The post has an upright vertical position when used to secure a parking place, and a horizontal lowered position when not in use. An internal locking mechanism locks the post in its upright secure position.

U.S. Pat. No. 3,660,935 to Boots, discloses a vehicle parking space locking device. The locking device consists of a cylindrical post that is disposed vertically in the ground and is capable of being locked in both an upright and lowered position. A square housing, affixed to the ground, provides a locking mechanism for the post in addition to supporting the post. The housing is disposed above the ground. A key lock controls a latching bar for locking the post in either an upright or lowered position.

The barrier post shown by Quante presents potential problems with the remote control operation. When used in a cold climate, the snow, ice and cold will effect the operation of the post. Thus, the post will not be able to extend into its upright position when an accumulation of ice and snow has occurred above the post when in its lowered position. The post of Doxsee does not retract into the ground, and therefore presents a hazard to those in the vicinity if the post. The post of Boots also presents a hazard to anyone in the vicinity of the post due to the housing being disposed above the ground. Furthermore, the locking mechanism is susceptible to being effected by cold weather.

SUMMARY OF THE INVENTION

The present invention overcomes the shortfalls of the prior art by providing a security post that is completely disposed in the ground when in a lowered position, and can be easily extended and locked into an upright position. When in its lowered position, the top portion of the post, including the lifting handle, is completely flush with the ground surface, thereby providing a safe environment in the vicinity of the post. The post is disposed within a sleeve that is completely recessed into the ground. Both the sleeve and the post have an end plate. A form fitted cover is provided to prevent the accumulation of ice, snow, dirt or other foreign particles on the top of the post and sleeve. Thus, when the post is in its lowered position, the cover will easily allow the user to erect the post without having to clean, shovel or chip away the dirt, snow and ice. When the post is in its upright position, the cover will prevent snow or ice from accumulating on the top of the post and thereby protect the lifting handle. When the post is brought into its upright position, a securing bolt passes through the bottom of the post to lock and maintain the post in said upright position. After the securing bolt has been placed through the post, a lock is secured through the bolt to prevent the removal thereof. A pair of ball plungers are disposed within the end plate of the sleeve such that when the post is raised to the upright position, the ball plungers will hold the post in the upright position while the securing bolt is placed in its locking position.

It is therefore an object of the present invention to provide a security post for automobiles that overcomes the shortfalls of the prior art.

It is another object of the invention to provide a security post for automobiles that is completely flush with the ground when in its lowered position.

Another object of the invention is to provide a security post for automobiles that operates efficiently under all weather circumstances.

Yet another object of the invention is to provide a security post for automobiles that is inexpensive to install and easily manufactured.

A further object of the invention is to provide a security post for automobiles that is reliable and cannot be entirely removed from the ground.

It is yet another object of the invention to provide a security post for automobiles that is easy to use and does not require extensive effort to operate.

BRIEF DESCRIPTION OF THE DRAWINGS

Other objects and features of the present invention will become apparent from the following detailed description considered in connection with the accompanying drawings which discloses one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1A:
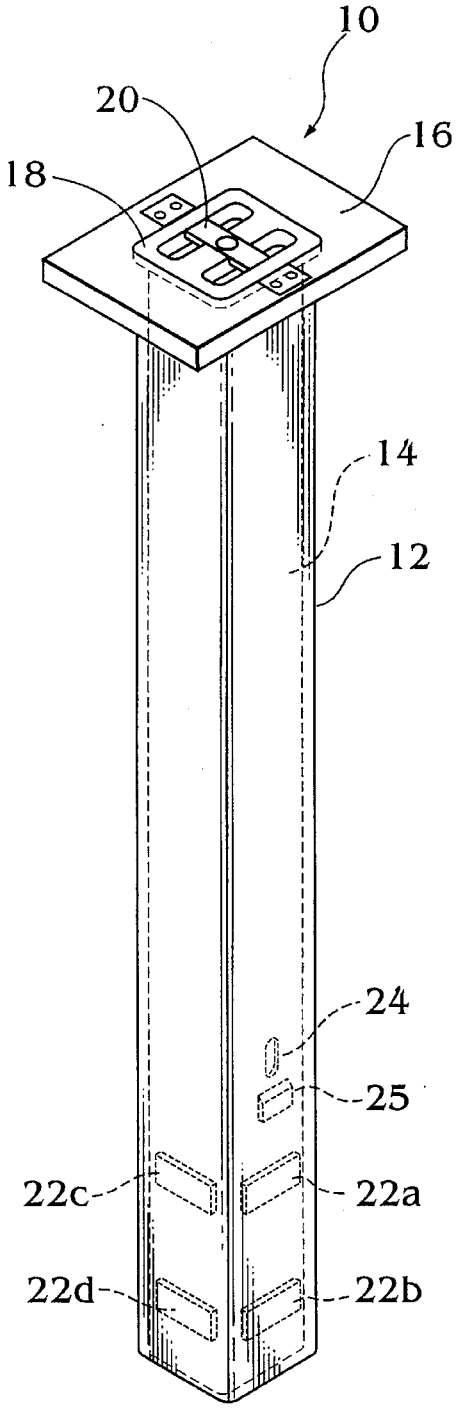
FIG. 1*a* is a perspective view of the security post of the invention.
Figure 3:
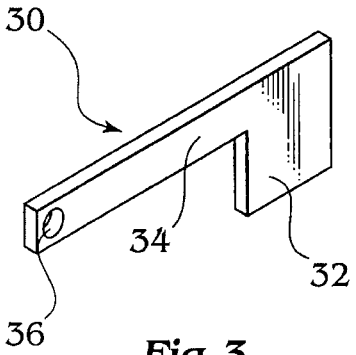
FIG. 3 is a perspective view of the securing bolt of the invention.

Turning now in detail to the drawings, FIG. 1*a* shows a perspective view of the security post 10 having a sleeve 12 and a post 14. The post 14 has an end plate 18 disposed on the top thereof, and a handle 20 within the end plate 18. The sleeve 12 has an end plate 16. The post 14 has guides 22*a*, 22*b*, 22*c* and 22*d* disposed near the bottom of said post for providing a smooth sliding action into and out of the sleeve 12. The post 14 has guides disposed on each of the four sides thereof near the bottom as illustrated by guides 22*a*, 22*b*, 22*c* and 22*d*. The guides on the other two sides of post 14 (not shown) are disposed symmetrically opposite guides 22*a*, 22*b*, 22*c* and 22*d* shown. A hole 24 centrally disposed through post 14 receives a securing bolt 30 (FIG. 3). The handle 20 fits within a recess 35 (FIG. 1*b*) such that when said handle is not in use, it is flush with the top of end plate 18.

Figure 1B:
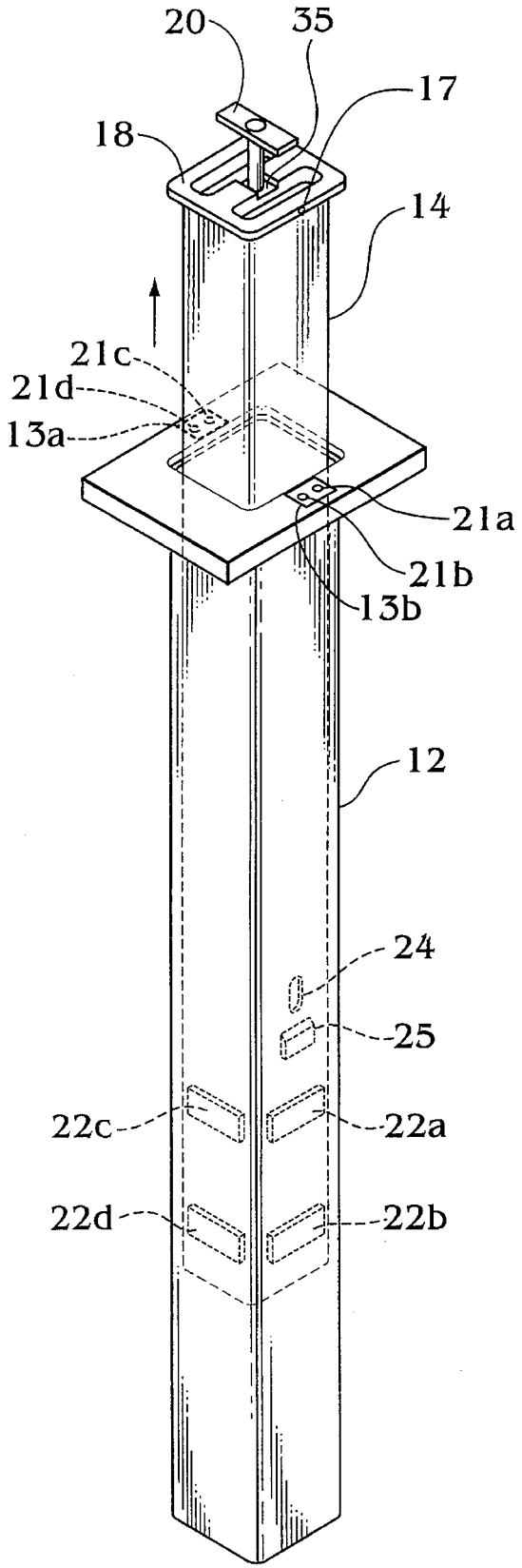
FIG. 1*b* is perspective view of the security post of the invention with the post partially raised.

FIG. 1*b* shows the security post 10 of the invention with the post 14 partially raised from sleeve 12. The end plate 16 of sleeve 12 has ball plungers 13*a* and 13*b* which are secured in place by hex screws 21*c* and 21*d*, and 21*a* and 21*b*, respectively. End plate 18 of post 14 has a notch 17 disposed therein such that end plate 18 does not interfere with ball plungers 13*a* and 13*b* when said post is in its lowered position. Strike plates 25 is disposed on opposite side of post 14 and near the bottom of said post below the securing hole 24 and above the guides 22*a* and 22*b*. When the post is raised, the ball plungers 13*a* and 13*b* are engaged by strike plates 25 such that said ball plungers extend into the path of the post. When post 14 is raised such that strike plates 25 are lifted beyond ball plungers 13*a* and 13*b*, the post 14 can be released and said ball plungers will hold said post in an upright position by causing said strike plates to rest on the extended ball plungers 13*a* and 13*b*. Strike plate 25 has an angled portion 27 that is angled downward to facilitate contact with ball plungers 13*a* and 13*b* during the lifting motion of post 14.

Figure 2A:
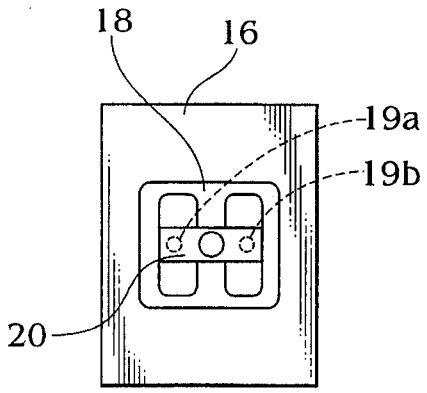
FIG. 2*a* is a top view of the security post of the invention.
Figure 2B:
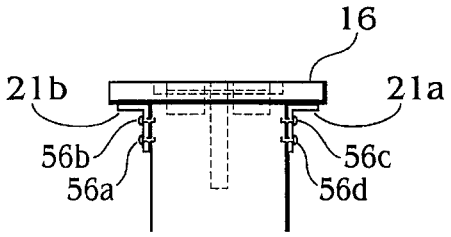
FIG. 2*b* is a side view of the security post of the invention.

FIG. 2*a* shows a top view of the end plates 16 and 18 of the sleeve and post, respectively. A pair of drain holes 19*a* and 19*b* are provided with end plate 18 to prevent the accumulation of water in said end plate. FIG. 2*b* shows a side view of the post and sleeve of the invention. End plate 16 is secured to sleeve 12 with L brackets 21*a* and 21*b*. The screws 56*a*, 56*b*, 56*c* and 56*d* that hold L-brackets 21*a* and 21*b* in place serve as stoppers for post 14 such that when post 14 is raised into its upright position, the uppermost guides will come into contact with said screws of said post if raised too much.

FIG. 3 shows the securing bolt 30 of the invention. Securing bolt 30 has and L-shape with the long portion 34 extending from a shorter and wider portion 32. A hole 36 is disposed at the end of the long portion 34 for receiving a lock 38 (FIG. 6).

Figure 4A:
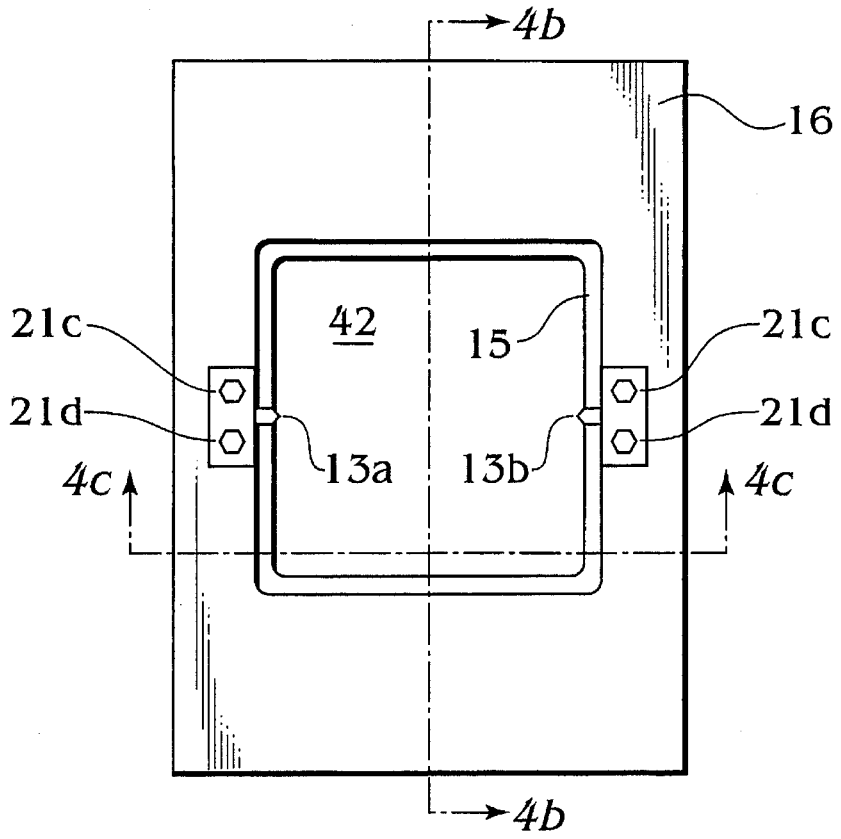
FIG. 4*a* is a top view of the sleeve end plate of the invention.
Figure 4B:
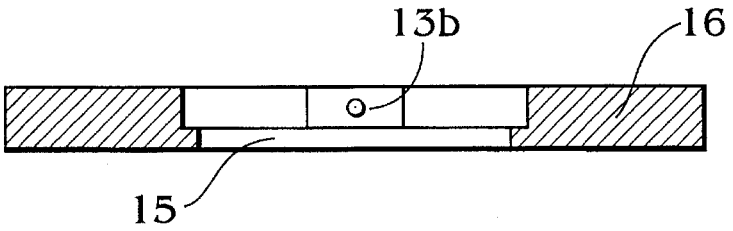
FIG. 4*b* is a cross-sectional view of the sleeve end plate of FIG. 4*a* taken along the line I—I of FIG. 4*a;*
Figure 4C:
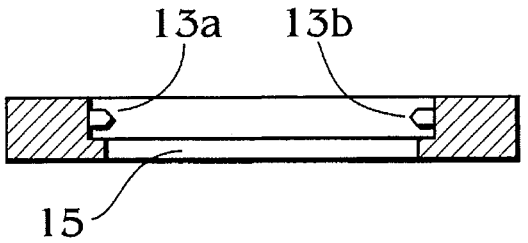
FIG. 4*c* is a cross-sectional view of the sleeve end plate of FIG. 4*a* taken along line II—II of FIG. 4*a;*

FIGS. 4*a*, 4*b* and 4*c* show the end plate 16 of the sleeve of the invention. End plate 16 has an opening 42 for receiving the post. Opening 42 has a lip 15 disposed therearound, such that when the post is inserted into the sleeve, the end plate 18 of the post 14 rests on lip 15 such that the top of end plate 18 is flush with the top of end plate 16 of the sleeve. Lip 15 also serves as a secondary stopper for preventing the post from coming out of the sleeve. Ball plungers 13*a* and 13*b* are disposed opposite each other across the opening 42 in end plate 16.

Figure 5A:
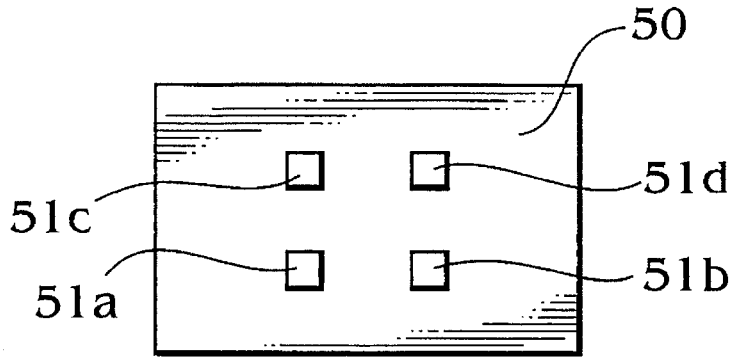
FIG. 5*a* is a top view of the cover for the security post of the invention.
Figure 5B:
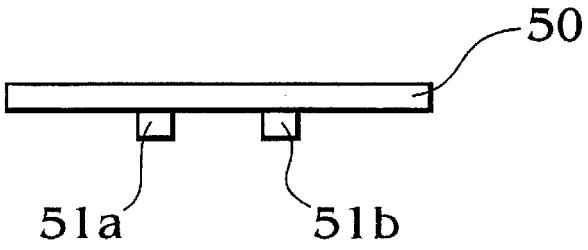
FIG. 5*b* is a side view of the cover for the security post of the invention.

FIGS. 5*a* and 5*b* show a form fitted cover 50 having indentations 51*a*, 51*b*, 51*c* and 51*d* for fitting into the top of end plate 18 of the post 14.

Figure 6:
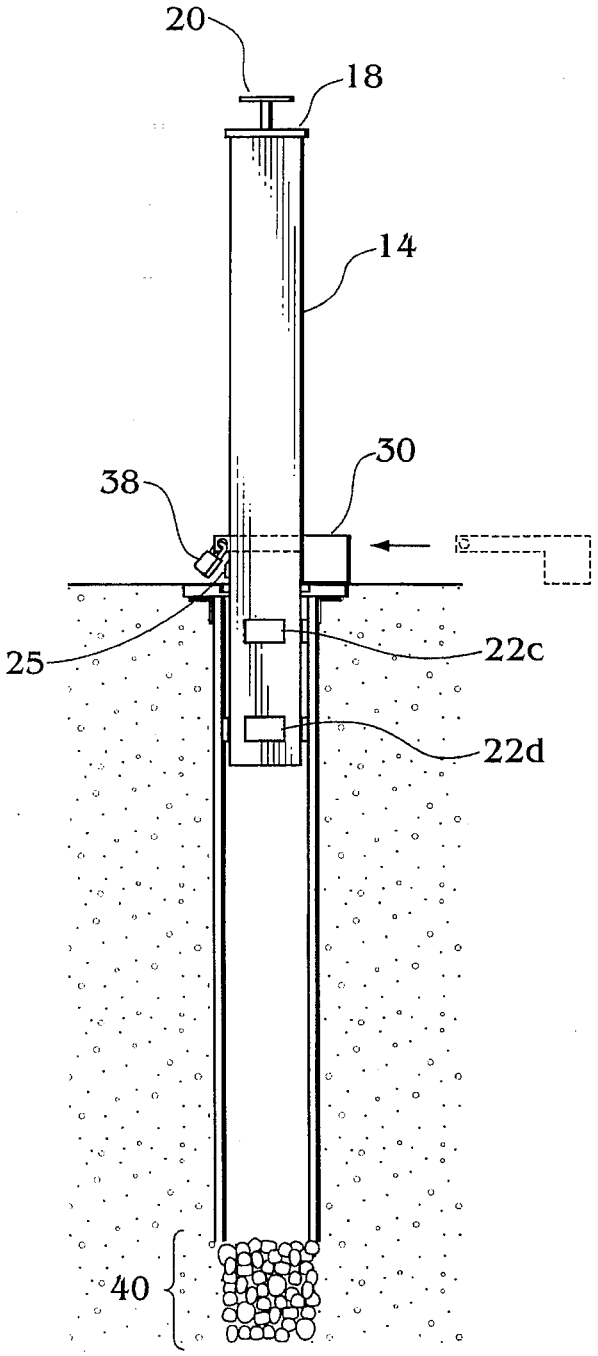
FIG. 6 is a partial cross-sectional view of the security post of the invention in an upright locked position.

FIG. 6 shows the post 14 in the upright position and secured in place by securing bolt 30 and lock 38. The sleeve 12 has an open bottom such that proper drainage is obtained. A bed of rocks 40 is disposed within the ground below the open bottom of the sleeve to further improve the drainage from the sleeve.

Figure 7A:
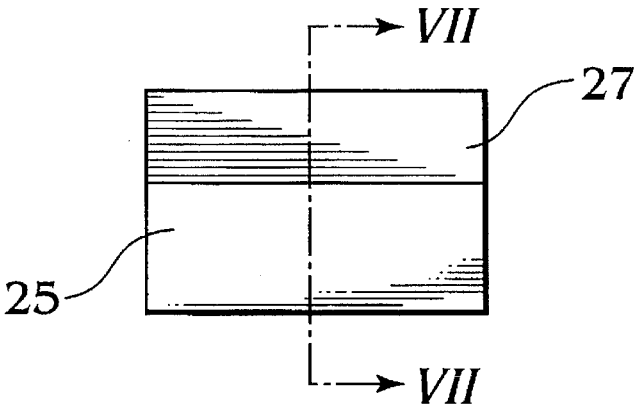
FIG. 7*a* is an elevational view of the strike plate according to the invention.
Figure 7B:
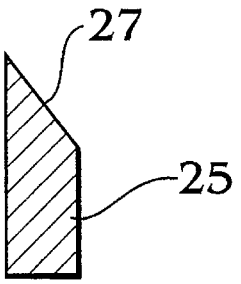
FIG. 7*b* is a cross-sectional view of the strike plate of FIG. 7*a* taken along line VII—VII of FIG. 7*a*.

FIGS. 7*a* and 7*b* show the strike plate 25 according to the invention. Strike plate 25 has an angled portion 27 that is angled downward and enables said strike plate to slidably engage ball plungers 13*a* and 13*b* within end plate 16 when post 14 is raised from its lowered position.

While only one embodiment of the present invention has been shown and described, it is to be understood that many changes and modifications may be made thereunto without departing from the spirit and scope of the invention as defined in the appended claims.

What is claimed is:

1. A security post comprising:

a hollow sleeve having a top and a bottom, said sleeve having at least one opening at said top;

a post slidably disposed in said hollow sleeve, said post having a top, a bottom and an outer surface;

a post end plate disposed on said top of said post, said post end plate comprises;

a substantially square plate having a pair of spaced rectangular parallel slots;

a recess between said slots, said recess being perpendicular to said slots and extending from one of said spaced parallel slots to the other of said parallel slots; and drain holes disposed within each of said pair of rectangular slots;

lifting means for raising and lowering said post, said lifting means formed in said post end plate;

stopping means for preventing said lifting means from raising said post out of said sleeve; and locking means for securing said post in an upright position, said locking means comprises:

a securing bolt having a first end and a spaced second end, each of said ends having a width, said first end having a hole therethrough, said width of said second end being larger than the width of said first end;

a bore through said post near said bottom of said post, said first end of said securing bolt being inserted through said bore such that said hole in said first end extends beyond the outer surface of said post to secure said post in an upright position; and a lock releasably fastened through said hole in said securing bolt.

2. The apparatus according to claim 1, wherein said lifting means comprises:

a handle having a top, a bottom, a first lowered position and a second raised position;

a cylindrical pin affixed to said bottom of said handle, said cylindrical pin slidably and rotatably disposed in said recess connecting said rectangular parallel slots; and whereby said handle fits into said recess between said slots when disposed in said first lowered position, and when said handle is lifted into said second position, said cylindrical pin is extended upward and allows said handle to be rotated freely to allow easy withdrawal of said post from said sleeve.

3. The apparatus according to claim 2, wherein when said handle is disposed in said recess in said first lowered position, said top of said handle is flush with said post end plate.

4. The apparatus according to claim 2, further comprising a sleeve end plate disposed on said top of said hollow sleeve, said sleeve end plate comprises:

a substantially rectangular plate having a substantially square opening therein for receiving said post, said square opening having a lip wherein, said post end plate rests on said lip of said sleeve end plate when said post is in a first lowered position; and fastening means for securing said sleeve end plate to said top of said sleeve.

5. The apparatus according to claim 4, wherein said stopping means comprises said sleeve end plate, said sleeve end plate preventing said lifting means from raising said post out of said sleeve.

6. The apparatus according to claim 4, wherein said stopping means is said fastening means for securing said sleeve end plate to said top of said sleeve.

7. The apparatus according to claim 4 further comprising:

sliding means connected to said post for enabling said post to slide freely within said sleeve;

holding means for maintaining said post in an upright position while said locking means is applied to said post; and a cover for covering said post end plate when said post is in a raised position, and for covering said post end plate and said sleeve end plate when said post is in a lowered position.

8. The apparatus according to claim 7, wherein said sliding means comprises a plurality of guides disposed on said outer surface near said bottom of said post.

9. The apparatus according to claim 4, wherein said sleeve has a substantially square cross-section.

10. The apparatus according to claim 9, wherein said post has a substantially square cross-section, said square cross-section of said post being slightly smaller than said square cross-section of said sleeve.

11. A security post comprising:

a hollow sleeve having a top and a bottom, said sleeve having at least one opening at said top;

a post slidably disposed in said hollow sleeve, said post having a top and a bottom;

a post end plate disposed on said top of said post;

a sleeve end plate disposed on said top of said hollow sleeve, said sleeve end plate comprises:

a substantially rectangular plate having a substantially square opening therein for receiving said post, said square opening having a lip disposed there around, said post end plate rests on said lip of said sleeve end plate when said post is in a first lowered position; and fastening means for securing said sleeve end plate to said top of said sleeve;

lifting means for raising and lowering said post, said lifting means formed in said post end plate;

sliding means connected to said post for enabling said post to slide freely within said sleeve;

holding means for maintaining said post in an upright position while said locking means is applied to said post, said holding means comprises:

strike plates disposed on said post; and ball plungers disposed in said end plate of said sleeve, said ball plungers extending into said opening in said end plate on said sleeve and engaged by said strike plates;

a cover for covering said post end plate and said sleeve end plate;

stopping means for preventing said lifting means from raising said post out of said sleeve; and locking means for securing said post in an upright position.

12. The apparatus according to claim 11, wherein said strike plates are disposed on said post below said bore through said post and above said sliding means, said strike plates having an upper edge and a lower edge.

13. The apparatus according to claim 12, wherein said upper edge of said strike plates is angled downward toward said bottom of said post and said lower edge of said strike plate extends outward from said post perpendicularly.

14. The apparatus according to claim 13, wherein said ball plungers are disposed opposite each other across said opening in said sleeve end plate and adjacent said lip around said opening.

15. The apparatus according to claim 14, wherein when said post is raised from said sleeve, said upper edge of said strike plates engage said ball plungers causing said ball plungers to extend further into said opening of said sleeve end plate such that said lower edge of said strike plates will rest on said ball plungers and maintain said post in an upright position.

16. The apparatus according to claim 11, wherein said sliding means comprises a plurality of guides disposed on said outer surface near said bottom of said post.

* * * * *